US009431158B2

(12) United States Patent
Tseng et al.

(10) Patent No.: US 9,431,158 B2
(45) Date of Patent: Aug. 30, 2016

(54) BARREL-SHAPED FIREPROOF AND EXPLOSION-PROOF SURGE PROTECTION DEVICE WITH OVER-TEMPERATURE PROTECTION FUNCTION

(71) Applicant: LONGKE ELECTRONICS (HUIYANG) CO., LTD., Huizhou, Guangdong (CN)

(72) Inventors: Chinglung Tseng, Miaoli (TW); Zetong Chen, Guangdong (CN)

(73) Assignee: LONGKE ELECTRONICS (HUIYANG) CO., LTD., Huizhou (CN)

( * ) Notice: Subject to any disclaimer, the term of this patent is extended or adjusted under 35 U.S.C. 154(b) by 0 days.

(21) Appl. No.: 14/829,664

(22) Filed: Aug. 19, 2015

(65) Prior Publication Data

US 2016/0055945 A1 Feb. 25, 2016

(30) Foreign Application Priority Data

Aug. 19, 2014 (CN) ..... 2014 2 0468725
Jan. 23, 2015 (CN) ..... 2015 2 0047035

(51) Int. Cl.
*H01C 7/10* (2006.01)
*H01C 7/12* (2006.01)
*H01C 1/14* (2006.01)
*H01C 7/105* (2006.01)

(52) U.S. Cl.
CPC .. *H01C 7/12* (2013.01); *H01C 1/14* (2013.01); *H01C 7/105* (2013.01)

(58) Field of Classification Search
CPC ..... H01C 7/12; H01C 1/02; H01C 1/14
USPC ..... 338/20, 21
See application file for complete search history.

(56) References Cited

U.S. PATENT DOCUMENTS 4,064,475 A * 12/1977 Kouchich ..... H01C 7/102 29/610.1
4,638,284 A * 1/1987 Levinson ..... H01R 13/53 338/21
5,596,308 A * 1/1997 Bock ..... H01C 7/12 338/20
6,040,971 A * 3/2000 Martenson ..... H01C 7/12 361/103
6,211,770 B1 * 4/2001 Coyle ..... H01C 7/126 338/101
6,731,490 B2 * 5/2004 Ikeda ..... H01T 21/00 361/120
8,816,812 B2 * 8/2014 Koprivsek ..... H01C 7/126 338/20
2007/0139850 A1 * 6/2007 Kamel ..... H01C 7/12 261/124

* cited by examiner

*Primary Examiner* — Kyung Lee

(57) ABSTRACT

The invention provides a barrel-shaped fireproof and explosion-proof surge protection device with the function of over-temperature protection, comprising a barrel-shaped housing, a barrel-shaped varistor and a cylindrical temperature protector, wherein the barrel-shaped housing houses the outer wall of the barrel-shaped varistor, the barrel-shaped varistor comprises a barrel-shaped varistor chip, an outer electrode, and an inner electrode, wherein the outer electrode is connected with an outer pin while the inner electrode is connected with an inner pin, the cylindrical temperature protector is arranged in the barrel space of the barrel-shaped varistor and is provided with two leading foots which are led out independently, or one of which is connected with the inner electrode of the barrel-shaped varistor and is led out, or one of which is connected with the inner electrode of the barrel-shaped varistor but is not led out.

12 Claims, 4 Drawing Sheets

BARREL-SHAPED FIREPROOF AND EXPLOSION-PROOF SURGE PROTECTION DEVICE WITH OVER-TEMPERATURE PROTECTION FUNCTION

CROSS-REFERENCE TO RELATED APPLICATIONS

This application claims the benefits of Chinese Patent Application No. 201420468725.9 filed on Aug. 19, 2014 and Chinese Patent Application No. 201520047035.0 filed on Jan. 23, 2015. The entire disclosures of the above applications are incorporated herein by reference.

FIELD OF THE INVENTION

The present invention relates to the field of surge protection device with varistor, more particularly to a barrel-shaped fireproof and explosion-proof surge protection device with the function of over-temperature protection.

BACKGROUND OF THE INVENTION

The existing surge protection device is mainly composed of single varistor or a plurality of varistors. The existing ZnO varistor (Metal Oxide Varistors, MOV) has specific nonlinear current-voltage characteristic. The voltage and current variation region of a typical varistor is divided into three regions comprising cut-off region, break-over region and overload degradation region. If unusual situation occurs during use, for example being struck by lightning, suffering interference from electromagnetic field, the power supply is turning on/off frequently, or faults occurring in power system, the varistor will enter the break-over region due to the sudden increase of the voltage in the line that exceeds the break-over voltage of varistor. At this point, current (I) has a nonlinear relationship with voltage (V), which is called nonlinearity parameter and may be up to dozens or hundreds. In this case, the impedance of varistor reduces to only a few Ohms. The overvoltage produces surge current to flow out, whereby protecting all connected electronic products and expensive components.

In routine techniques, though varistor composed of ZnO chip has good protective effect on transient surge, it cannot protect the power system from transient overvoltage, or even resulting in fire. Thus it is standard choice to cut off the circuit or go off the grid. To this end, thermal fuse and current fuse are also usually used in the device in addition to switches.

However, due to its planar rectangle or planar circular shape, traditional surge protection device has a disadvantage of big occupied space in use that cannot meet the requirements of electronics securitization, miniaturization and inexpensiveness.

SUMMARY OF THE INVENTION

In order to overcome the disadvantage in the prior art, the present invention provides a barrel-shaped fireproof and explosion-proof surge protection device with the function of over-temperature protection, having small size, easy installation as well as safety and convenient usage.

In order to solve the above technical problems, the present invention provides a technical solution as follows:

A barrel-shaped fireproof and explosion-proof surge protection device with the function of over-temperature protection, comprising a barrel-shaped housing, a barrel-shaped varistor and a cylindrical temperature protector, wherein the barrel-shaped housing houses the outer wall of the barrel-shaped varistor, the barrel-shaped varistor comprises a barrel-shaped varistor chip, an outer electrode arranged on the outer circular wall and outer top of the barrel-shaped varistor chip, and an inner electrode arranged on the inner circular wall and inner top of the barrel-shaped varistor chip, wherein the outer electrode is connected with an outer pin while the inner electrode is connected with an inner pin, the cylindrical temperature protector is arranged in the barrel space of the barrel-shaped varistor and is provided with two leading foots which are led out independently, or one of which is connected with the inner electrode of the barrel-shaped varistor and is led out, or one of which is connected with the inner electrode of the barrel-shaped varistor but is not led out, whereby forming barrel-shaped fireproof and explosion-proof surge protection devices having a function of over-temperature protection with different forms of circuits.

Preferably, the barrel-shaped housing has an inner diameter of 5 mm to 25 mm, has a depth of 5 mm to 25 mm, and has a wall thickness of 0.3 mm to 2 mm.

Preferably, the barrel-shaped varistor has an inner diameter of 5 mm to 17 mm, has an outer diameter of 7 mm to 25 mm, has a length of 4 mm to 25 mm, and has a bottom thickness of 1 mm to 4 mm.

Preferably, the outer electrode and the inner electrode are silver electrode, copper electrode, aluminum-copper combination electrode, aluminum-zinc combination electrode, or aluminum-tin combination electrode.

Preferably, the outer electrode of the barrel-shaped varistor is directly connected with the outer pin when the barrel-shaped housing is made of non-metallic material with heat resistance.

Preferably, when the barrel-shaped housing is made of metallic material, the barrel-shaped housing directly covers and presses against the outer electrode of the barrel-shaped varistor, wherein the barrel-shaped housing is arranged with a pin as the outer pin.

Preferably, the pin arranged on the barrel-shaped housing has a length of 2 mm to 20 mm, and has a width of 0.3 mm to 5 mm.

Preferably, the outer diameter of the cylindrical temperature protector is smaller than or equal to the inner diameter of the barrel-shaped varistor, and the height of the cylindrical temperature protector is smaller than or equal to the depth of the barrel space of the barrel-shaped varistor.

Preferably, the cylindrical temperature protector has a fusing-off temperature ranging from 85° C. to 180° C., with every standard per 5° C.

Preferably, the cylindrical temperature protector uses over-current protector or over-voltage protector as need.

The present invention has advantages as follows:

1. The barrel-shaped fireproof and explosion-proof surge protection device with the function of over-temperature protection provided by the present invention is fireproof and explosion-proof due to the use of barrel-shaped housing. It has a function of over-temperature protection because the temperature protector has a characteristic of fusing and resulting in open circuit when the temperature exceeds the higher limit. Thereby, the security in actual use is improved;

2. The present invention designs a varistor with barrel shape, effectively using space;

3. The cylindrical temperature protector is arranged in the barrel space of the barrel-shaped varistor, having advantages of accurate temperature-sensing without affected by outside and avoiding malfunction;

4. The temperature protector is arranged in the barrel space of the barrel-shaped varistor, without affecting adjacent components and parts in certain circumstances. It has a smaller size, greater security and higher reliability.

DETAILED DESCRIPTION OF ILLUSTRATED EMBODIMENTS

Embodiments of the present invention will be explained below in detail with reference to figures. It should be noted that figures is merely intended to illustrate and explain, but not limit the scope of the present invention.

Embodiment 1

Figure 1:
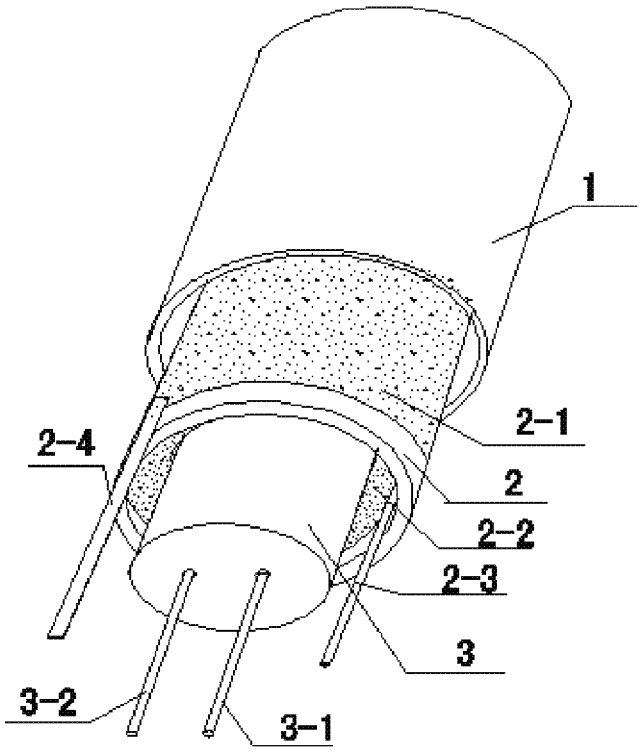
FIG. 1 is a schematic diagram of embodiment 1 according to the present invention.
Figure 6:
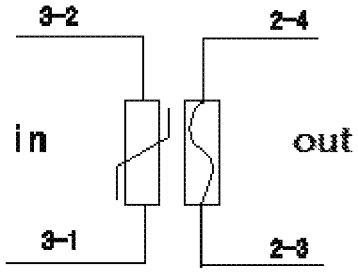
FIG. 6 is an equivalent circuit diagram of FIG. 1 according to the present invention.

As shown in FIG. 1, a barrel-shaped fireproof and explosion-proof surge protection device with the function of over-temperature protection is provided in this embodiment. It comprises a barrel-shaped housing 1, a barrel-shaped varistor 2 and a cylindrical temperature protector 3, wherein the barrel-shaped housing 1 houses the outer wall of the barrel-shaped varistor 2, the barrel-shaped varistor 2 comprises a barrel-shaped varistor chip, an outer electrode 2-1 arranged on the outer circular wall and outer top of the barrel-shaped varistor chip, and an inner electrode 2-2 arranged on the inner circular wall and inner top of the barrel-shaped varistor chip, wherein the outer electrode 2-1 is connected with an outer pin 2-4 while the inner electrode 2-2 is connected with an inner pin 2-3, the cylindrical temperature protector 3 is arranged in the barrel space of the barrel-shaped varistor 2 and is provided with two leading foots 3-1, 3-2 which are led out independently, whereby forming a barrel-shaped fireproof and explosion-proof surge protection device having a function of over-temperature protection in a form of first equivalent circuit as shown in FIG. 6.

The barrel-shaped housing 1 is poured with flame retardant sealant from the opening and thus is sealed, and it is put into a dryer to be dried under a temperature of 60-150° C. for 10-45 mins. Thereby, it is fireproof and explosion-proof.

In this embodiment, the outer electrode 2-1 of the barrel-shaped varistor 2 is directly connected with the outer pin when the barrel-shaped housing 1 is made of non-metallic material with heat resistance, such as ceram, flame retardant plastic, etc. The barrel-shaped housing 1 has an inner diameter of 10 mm, has a depth of 11 mm, and has a wall thickness of 1 mm.

In this embodiment, the outer electrode 2-1 and the inner electrode 2-2 of the barrel-shaped varistor 2 are silver electrode, copper electrode, aluminum electrode, aluminum-copper combination electrode, or aluminum-nickel combination electrode.

The barrel-shaped varistor 2 has a barrel-shaped varistor chip having inner and outer circular wall with an inner diameter of 5 mm, an outer diameter of 9 mm, a length of 10 mm, and a bottom thickness of 1 mm.

In this embodiment, the pin arranged on the barrel-shaped housing has a length of 5 mm, and has a width of 2.5 mm.

The cylindrical temperature protector 3 is arranged with two leading foots 3-1, 3-2 in a direction parallel to the cylindrical. The outer diameter of the temperature protector is smaller than or equal to the inner diameter of the barrel-shaped varistor, and the length of the temperature protector is smaller than or equal to the depth of the barrel-shaped varistor, so that it can be put into the barrel space of the barrel-shaped varistor.

In this embodiment, the cylindrical temperature protector 3 is Tin alloy temperature protector. The cylindrical Tin alloy temperature protector has a fusing-off temperature ranging from 85° C. to 180° C., with every standard per 5° C. The cylindrical temperature protector 3 uses over-current protector or over-voltage protector as need.

The barrel-shaped fireproof and explosion-proof surge protection device with the function of over-temperature protection provided by this embodiment has an advantage that it can be combined optionally in the circuit by the user.

Embodiment 2

Figure 2:
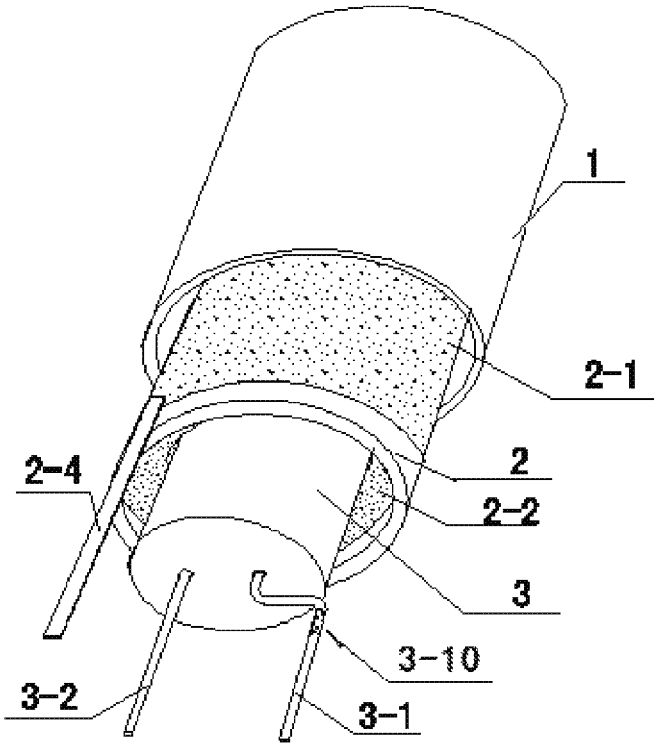
FIG. 2 is a schematic diagram of embodiment 2 according to the present invention.
Figure 7:
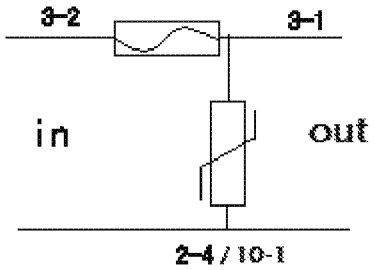
FIG. 7 is an equivalent circuit diagram of FIGS. 2, 4 according to the present invention.

In this embodiment, in contrast with FIG. 1, the inner electrode 2-2 of the barrel-shaped varistor 2 is not lead out by the inner pin 2-3, as shown in FIG. 2. Since the height of the cylindrical temperature protector 3 in this embodiment is smaller than the depth of the barrel space of the barrel-shaped varistor 2, when the cylindrical temperature protector 3 is put into the barrel space of the barrel-shaped varistor 2, the edge of the inner electrode 2-2 is higher than the edge of the cylindrical temperature protector 3 for at least 1-3 mm. One leading foot 3-1 of the cylindrical temperature protector is bended and is welded with the inner electrode 2-2 at the bending position 3-10, forming a barrel-shaped fireproof and explosion-proof surge protection device with the function of over-temperature protection having three leading foots 3-1, 3-2, 2-4. The equivalent circuit thereof is shown in FIG. 7.

Embodiment 3

Figure 3:
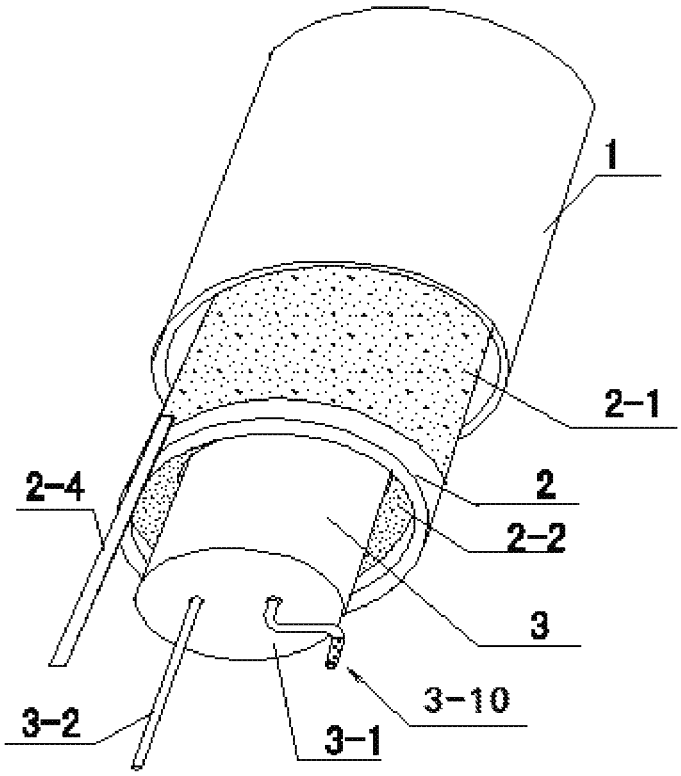
FIG. 3 is a schematic diagram of embodiment 3 according to the present invention.
Figure 8:
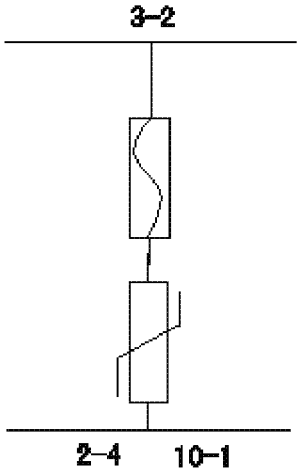
FIG. 8 is an equivalent circuit diagram of FIGS. 3, 5 according to the present invention.

In this embodiment, in contrast with FIG. 2, the leading foot 3-1 of the cylindrical temperature protector 3 in this embodiment is welded with the inner electrode 2-2 of the barrel-shaped varistor 2 at the bending position 3-10, as shown in FIG. 3, the spare parts of the leading foot is cut off, and this leading foot is not lead out. Thereby, a barrel-shaped fireproof and explosion-proof surge protection device with the function of over-temperature protection having two leading foots 3-2, 2-4 is formed. The equivalent circuit thereof is shown in FIG. 8.

Embodiment 4

Figure 4:
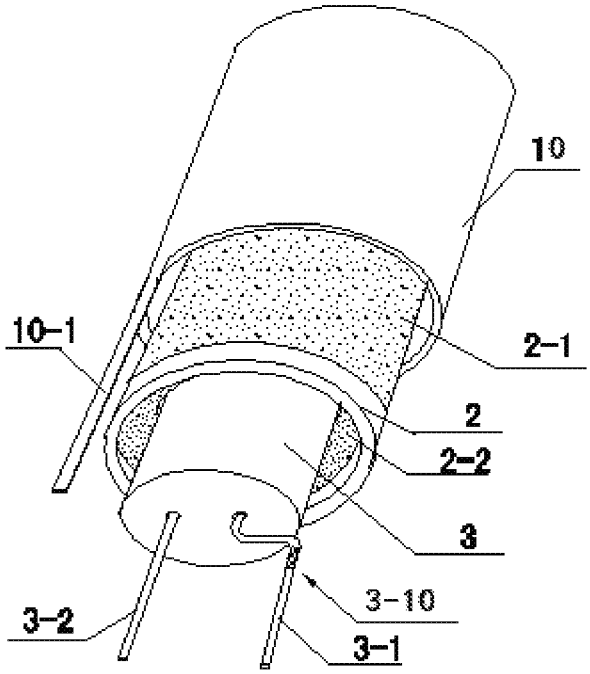
FIG. 4 is a schematic diagram of embodiment 4 according to the present invention.

This embodiment is different from embodiment 2 in that the barrel-shaped housing is made of metallic material, such as cooper, aluminum or aluminium alloy. In this embodiment, as shown in FIG. 4, the barrel-shaped housing 10 directly covers and presses against the outer electrode 2-4 of the barrel-shaped varistor 2, wherein the barrel-shaped housing 10 is arranged with a pin as the outer pin 10-1. In this embodiment, the outer pin 10-1 has a length of 2 mm-10 mm, and has a width of 0.3-3 mm.

In this embodiment, the outer electrode 2-1 and the inner electrode 2-2 arranged on the barrel-shaped varistor 2 are aluminum electrodes or copper-base aluminum coated electrodes. The outer electrode 2-1 is not welded with the outer leading foot 2-4. Rather than that, the metallic barrel-shaped housing 10 covers the outer electrode 2-1 of the barrel-shaped varistor 2 under a pressure, thereby pressing against it and being connected with it closely. In addition, the pin 10-1 of the barrel-shaped housing 10 is used as the pin of the outer electrode. Thereby, a barrel-shaped fireproof and explosion-proof surge protection device with the function of over-temperature protection having three leading foots 3-1, 3-2, 10-1 is formed. The equivalent circuit thereof is shown in FIG. 7.

Embodiment 5

Figure 5:
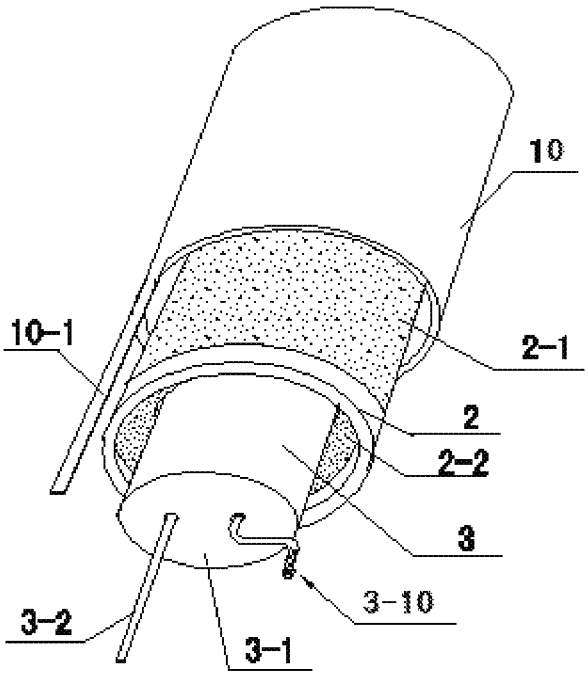
FIG. 5 is a schematic diagram of embodiment 5 according to the present invention.

As shown in FIG. 5, this embodiment is different from embodiment 4 in that the leading foot 3-1 of the cylindrical temperature protector 3 is welded with the inner electrode 2-2 of the barrel-shaped varistor 2, and the spare parts of the leading foot is cut off, and this leading foot is not lead out. Thereby, a barrel-shaped fireproof and explosion-proof surge protection device with the function of over-temperature protection having two leading foots 3-2, 10-1 is formed. The equivalent circuit thereof is shown in FIG. 8.

All the above embodiments are merely the preferred embodiments of the present invention, but are not intended to limit the scope of the invention. The present invention is intended to cover all changes, modifications, alternatives, regroups and simplifications as equivalent arrangements included within the spirit and principle of the present invention according to the technical essence of the present invention.

What is claimed is:

1. A barrel-shaped fireproof and explosion-proof surge protection device with the function of over-temperature protection, characterized by comprising: a barrel-shaped housing, a barrel-shaped varistor and a cylindrical temperature protector, wherein the barrel-shaped housing houses the outer wall of the barrel-shaped varistor, the barrel-shaped varistor comprises a barrel-shaped varistor chip, an outer electrode arranged on the outer circular wall and outer top of the barrel-shaped varistor chip, and an inner electrode arranged on the inner circular wall and inner top of the barrel-shaped varistor chip, wherein the outer electrode is connected with an outer pin while the inner electrode is connected with an inner pin; the cylindrical temperature protector is arranged in the barrel space of the barrel-shaped varistor and is provided with two leading foots which are led out independently, or one of which is connected with the inner electrode of the barrel-shaped varistor and is led out, or one of which is connected with the inner electrode of the barrel-shaped varistor but is not led out, whereby forming barrel-shaped fireproof and explosion-proof surge protection devices having the function of over-temperature protection with different forms of circuits.

2. The barrel-shaped fireproof and explosion-proof surge protection device with the function of over-temperature protection according to claim 1, characterized in that: the barrel-shaped housing has an inner diameter of 5 mm to 25 mm, has a depth of 5 mm to 25 mm, and has a wall thickness of 0.3 mm to 2 mm.

3. The barrel-shaped fireproof and explosion-proof surge protection device with the function of over-temperature protection according to claim 1, characterized in that: the barrel-shaped varistor has an inner diameter of 5 mm to 17 mm, has an outer diameter of 7 mm to 25 mm, has a length of 4 mm to 25 mm, and has a bottom thickness of 1 mm to 4 mm.

4. The barrel-shaped fireproof and explosion-proof surge protection device with the function of over-temperature protection according to claim 1, characterized in that: the outer electrode and the inner electrode are silver electrode, copper electrode, aluminum-copper combination electrode, aluminum-zinc combination electrode, or aluminum-tin combination electrode.

5. The barrel-shaped fireproof and explosion-proof surge protection device with the function of over-temperature protection according to claim 1, characterized in that: the outer electrode of the barrel-shaped varistor is directly connected with the outer pin when the barrel-shaped housing is made of non-metallic material with heat resistance.

6. The barrel-shaped fireproof and explosion-proof surge protection device with the function of over-temperature protection according to claim 1, characterized in that: when the barrel-shaped housing is made of metallic material, the barrel-shaped housing directly covers and presses against the outer electrode of the barrel-shaped varistor, wherein the barrel-shaped housing is arranged with a pin as the outer pin.

7. The barrel-shaped fireproof and explosion-proof surge protection device with the function of over-temperature protection according to claim 6, characterized in that: the pin arranged on the barrel-shaped housing has a length of 2 mm to 20 mm, and has a width of 0.3 mm to 5 mm.

8. The barrel-shaped fireproof and explosion-proof surge protection device with the function of over-temperature protection according to claim 1, characterized in that: the outer diameter of the cylindrical temperature protector is smaller than or equal to the inner diameter of the barrel-shaped varistor, and the height of the cylindrical temperature protector is smaller than or equal to the depth of the barrel space of the barrel-shaped varistor.

9. The barrel-shaped fireproof and explosion-proof surge protection device with the function of over-temperature protection according to claim 8, characterized in that: the cylindrical temperature protector has a fusing-off temperature ranging from 85° C. to 180° C., with every standard per 5° C.

10. The barrel-shaped fireproof and explosion-proof surge protection device with the function of over-temperature protection according to claim 8, characterized in that: the cylindrical temperature protector uses over-current protector or over-voltage protector as need.

11. The barrel-shaped fireproof and explosion-proof surge protection device with the function of over-temperature protection according to claim 1, characterized in that: the cylindrical temperature protector has a fusing-off temperature ranging from 85° C. to 180° C., with every standard per 5° C.

12. The barrel-shaped fireproof and explosion-proof surge protection device with the function of over-temperature protection according to claim 1, characterized in that: the cylindrical temperature protector uses over-current protector or over-voltage protector as need.

* * * * *